US008752252B2

(12) United States Patent
Ninomiya et al.

(10) Patent No.: US 8,752,252 B2
(45) Date of Patent: Jun. 17, 2014

(54) MAGNETIC JEWELRY CLASP

(75) Inventors: Tomoyasu Ninomiya, Tokyo (JP); Mitsugi Ishida, New York, NY (US)

(73) Assignee: Mitsugi Ishida, New York, NY (US)

( * ) Notice: Subject to any disclaimer, the term of this patent is extended or adjusted under 35 U.S.C. 154(b) by 77 days.

(21) Appl. No.: 13/117,847

(22) Filed: May 27, 2011

(65) Prior Publication Data

US 2011/0289737 A1 Dec. 1, 2011

(30) Foreign Application Priority Data

Jun. 1, 2010 (JP) ..... 2010-125894

(51) Int. Cl.
*A44C 5/00* (2006.01)
*H01F 7/02* (2006.01)

(52) U.S. Cl.
USPC ..... 24/303

(58) Field of Classification Search
CPC A45C 13/1069; A45C 13/1084; A41F 1/002; H01F 7/0263
USPC ..... 24/303
See application file for complete search history.

(56) References Cited

U.S. PATENT DOCUMENTS 2,615,227 A 10/1952 Hornik
2,648,884 A 8/1953 Loofboro
3,086,268 A * 4/1963 Chaffin, Jr. ..... 24/303
3,129,477 A 4/1964 Mizuno
4,021,891 A 5/1977 Morita
4,231,137 A 11/1980 Fujimoto
4,480,361 A * 11/1984 Morita ..... 24/303
4,622,726 A 11/1986 Nakamura
4,982,581 A 1/1991 Furuyama
5,050,276 A 9/1991 Pemberton
5,099,659 A 3/1992 Carranza
5,367,891 A 11/1994 Furuyama
5,432,986 A * 7/1995 Sexton ..... 24/303
5,572,887 A 11/1996 Geswelli
5,664,298 A 9/1997 Nessar-Ivanovic
5,722,126 A 3/1998 Reiter
5,722,260 A 3/1998 Mangano
5,845,373 A 12/1998 Langer
5,933,926 A 8/1999 Reiter
6,131,247 A * 10/2000 Morita ..... 24/303
6,145,341 A 11/2000 Leong
6,282,760 B1 9/2001 Mars
6,473,946 B1 * 11/2002 Cheng ..... 24/303
6,481,065 B2 11/2002 Cogdill
6,505,385 B2 1/2003 Grunberger
6,564,434 B1 * 5/2003 Morita ..... 24/303
6,598,272 B2 7/2003 Nire
6,640,398 B2 11/2003 Hoffman
6,981,391 B2 1/2006 Suzuki
7,065,841 B2 * 6/2006 Sjoquist ..... 24/303

(Continued)

*Primary Examiner* — Robert J Sandy
*Assistant Examiner* — David Upchurch
(74) *Attorney, Agent, or Firm* — Bruzga & Associates; Charles E. Bruzga; Jay S. Pattumudi

(57) ABSTRACT

A clasp in which magnetic leakage is reduced includes a pair of pieces which are to be engaged with each other. Both pieces, when being engaged, both may rotate about an axis common to both pieces. Both pieces are provided with a pair of permanent magnets held in both pieces. Both permanent magnets have front and rear surfaces in which multiple poles are magnetized, and when both pieces are engaged, the front surfaces of both permanent magnets face each other.

9 Claims, 14 Drawing Sheets

(56) References Cited

U.S. PATENT DOCUMENTS

| | | | | |
|---|---|---|---|---|
| D601,916 | S | 10/2009 | Moss | |
| 2003/0005558 | A1 | 1/2003 | Wong | |
| 2003/0024079 | A1* | 2/2003 | Morita | 24/303 |
| 2003/0154576 | A1 | 8/2003 | Mirharooni | |
| 2006/0005361 | A1* | 1/2006 | O'Banion | 24/303 |
| 2006/0096070 | A1 | 5/2006 | Ishida | |
| 2007/0028429 | A1 | 2/2007 | Ishida | |

* cited by examiner

MAGNETIC JEWELRY CLASP

CROSS-REFERENCE TO RELATED APPLICATIONS

This application claims priority to Japanese Patent Application No. 2010-125894, filed on Jun. 1, 2010, the disclosure of which is incorporated herein by reference.

FIELD OF THE INVENTION

The field relates to a clasp being a securing member used for mutual, coupling between end portions in an accessory such as a necklace or a bracelet, or in a belt or the like, for mutual coupling between curtains, or for securing a mouth of a purse or a bag.

BACKGROUND

Conventionally, there has been proposed a clasp using a magnetic attraction force and a magnetic repulsion force between permanent magnets as a means for coupling end portions of an accessory such as a necklace or a bracelet and releasing the end portions; or for securing a mouth of a purse or a bag and releasing the securing. Such examples of clasps are disclosed in U.S. Patent Publication No. 2006/0096070 and U.S. Patent Publication No. 2007/0028429.

The above-described conventional clasp in the references is provided with a pair of pieces, with each having a permanent magnet incorporated therein, and both the pieces are attached to both end portions of an accessory or to a main body of a purse or a bag and its flap. Both pieces, by making opposite poles of these permanent magnets face each other, receive a magnetic attraction force to be coupled to each other. Accordingly, both the end portions of the accessory are coupled, or a mouth of the purse or the bag is secured. Further, when both the coupled pieces are rotated about an axis line of both the pieces to make the same poles of both the permanent magnets face each other, both pieces receive a magnetic repulsion force to be separated from each other. Accordingly, the coupling of both the end portions of the accessory is released, or the state of the mouth of the purse or the bag being secured is released.

However, as the permanent magnets are to be used for the clasp, a relatively high magnetic attraction force, namely a relatively strong magnetic force, is exhibited such that both pieces coupled to each other are not easily separated from each other. But, on the other hand, there is a concern that a precision instrument such as, for example, a wristwatch being one of personal belongings, is adversely affected by magnetic leakage of the strong, permanent magnets.

SUMMARY OF THE INVENTION

An object is to provide a clasp in which magnetic leakage is relatively reduced.

(Feature of Invention of Claim 1)

A clasp according to claim 1 relates to a clasp, and includes: a pair of pieces being a pair of pieces to be engaged with each other and, when being engaged, are being capable of both rotating about an axis line common to both the pieces; and a pair of permanent magnets being a pair of permanent magnets held in both the pieces and having front and rear surfaces in which multiple poles are magnetized and, when both the pieces are engaged, having the front surfaces thereof face each other.

According to the clasp described in claim 1, the pair of pieces, when the front surfaces of the pair of permanent magnets held in the pieces face each other with the opposite poles, is coupled to each other due to a magnetic attraction force generated between both the permanent magnets. The coupling of both the pieces allows for coupling both end portions of, for example, a necklace, a bracelet, or a belt, to lock a mouth of a purse or a bag, to couple curtains, and so on via both the pieces. Further, when both the pieces are rotated about the axis line common to both the pieces to make the front surfaces of both the permanent magnets face each other with the same poles, the coupling between both the pieces due to a magnetic repulsion force generated between both the permanent magnets may be released. This allows for release the mutual coupling in the above-described necklace or the like, to release the locking of the mouth of the above-described purse or the like, and so on. In the present invention, since the above-described permanent magnets are each made of what is called a double-sided multipolar type in which multiple poles are magnetized in its front and rear surfaces, a reduction of an amount of magnetic or magnetic flux leakage from the above-described pieces occurs as compared with what is called a single-sided multipolar type in which multiple poles are magnetized only in, for example, a front surface, what is called a single-sided single polar type in which one pole is magnetized in one surface, and so on.

(Feature of Invention of Claim 2)

A clasp according to claim 2 further includes a back yoke held in each of the pieces and coming into contact with the rear surface of each of the permanent magnets in addition to components of the invention according to claim 1.

According to the clasp described in claim 2, since the back yoke coming into contact with the rear surface of each of the permanent magnets is provided, an air discharge amount of magnetic lines of force extending from the rear surface of the one permanent magnet to the rear surface of the other permanent magnet is further reduced, and this thus further reduces the amount of magnetic leakage.

(Feature of Invention of Claim 3)

A clasp according to claim 3, in which one and the other of both the pieces according to claim 2 have a shaft extending along the axis line common to both the pieces and a hole receiving the shaft therein, and the permanent magnet and the back yoke that are held in the one piece have a through hole for the shaft, and further the permanent magnet held in the other piece has a through hole defining the hole receiving the shaft therein.

According to the clasp described in claim 3, it is possible to relatively rotate both the pieces about the axis line common to both the pieces via the shaft and the hole receiving the shaft therein that are provided in both the pieces.

(Feature of Invention of Claim 4)

A clasp according to claim 4, in which both the pieces according to claim 1 or 2 have a projection formed around the axis line common to both the pieces and extending in a circumferential direction of the axis line and a groove receiving the projection therein and exerting a guiding function in the circumferential direction of the common axis line on the projection, and the projection has a center portion and both end portions in terms of the circumferential direction of the common axis line, and has a thickness dimension gradually decreasing from the center portion to the respective end portions, and further the groove has a center portion and both end portions in terms of the circumferential direction of the common axis line, and has a depth dimension gradually decreasing from the center portion to the respective end portions.

According to the clasp described in claim 4, it is possible to relatively rotate both the pieces about the axis line common to both the pieces via the projection and the groove receiving the projection therein that are provided in both the pieces. In the present invention, since the thickness dimension of the above-described projection gradually decreases from the center portion to the respective end portions, and further the depth dimension of the groove receiving the above-described projection therein gradually decreases from the center portion to the respective end portions, when both the pieces are relatively rotated, it is possible to make the front surfaces of both the permanent magnets held in both the pieces gradually approach or separate from each other.

(Feature of Invention of Claim 5)

A clasp according to claim 5, in which both the pieces according to claim 1 or 2 include a projecting portion and a recessed portion receiving the projecting portion therein that face each other, and the projecting portion and the recessed portion have circumferential surfaces each formed by a cylindrical surface, which come into contact with each other to be capable of sliding about the axis line common to both the pieces.

According to the clasp described in claim 5, it is possible to relatively rotate both the pieces about the axis line common to both the pieces via the circumferential surfaces formed by the cylindrical surfaces of the projecting portion and the recessed portion receiving the projecting portion therein that are provided in both the pieces.

(Feature of Invention of Claim 6)

A clasp according to claim 6, in which the other piece according to any one of claims 1 to 4 has a fingerhold portion for generating rotation of to the other piece relative to the one piece.

According to the clasp described in claim 6, for example, fingers are put on the fingerhold portion provided in the other piece to apply a rotational external force to the fingerhold portion, thereby enabling the other piece to rotate about the axis line common to both the pieces relative to the one piece.

(Feature of Invention of Claim 7)

A clasp according to claim 7, in which the one piece according to any one of claims 1 to 6 includes a loop attached thereto so as to be capable of rotating around the periphery of said one piece; and said other piece includes a loop fixed thereto.

According to the clasp described in claim 7, it is possible to set both the loops of both the pieces to be connection portions of both the pieces to both the end portions of, for example, the accessory. Further, the one loop can rotate according to a size of an angle formed when both the end portions of the necklace cross, which changes depending on a body shape of a wearer of, for example, the necklace being an application object of the clasp or on a length of the necklace.

(Feature of Invention of Claim 8)

A clasp according to claim 8, in which each of the pieces according to any one of claims 1 to 7 has a hexagonal hole for holding each of the permanent magnets therein, and each of the permanent magnets has a planar shape substantially the same as that of the hole.

According to the clasp described in claim 8, since in each of the pieces, the hole holding each of the permanent magnets therein and the planar shape of the permanent magnet are designed to be the polygons, which are substantially the same as each other, occurrence of rotational movements of both the permanent magnets relative to both the pieces at the time of forcible rotational manipulation of both the pieces is securely prevented, and consequently integral rotation with both the pieces is secured.

According to one example of the clasp, a clasp using permanent magnets in which magnetic leakage is relatively reduced. may be designed.

DETAILED DESCRIPTION

The examples and drawings provided in the detailed description are merely examples, which should not be used to limit the scope of the claims in any claim construction or interpretation.

Figure 1:
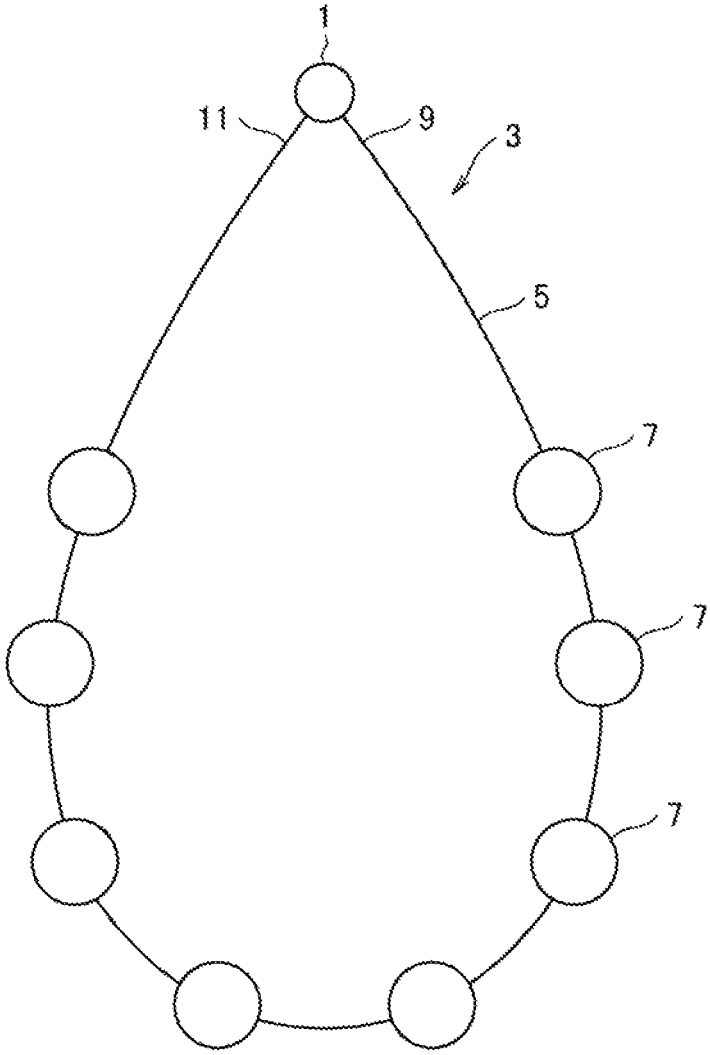
FIG. 1 is a schematic view of a necklace to which a clasp is according to one example of the present invention is applied.

Referring to FIG. 1, there is illustrated a necklace 3 being one example of an application object of a clasp 1 according to the present invention. The above necklace 3 is provided with a string 5 and a plurality of pearls 7 threaded on the string, and both end portions 9, 11 of the string 5 to be both end portions of the necklace 3 are coupled via the clasp 1 to be capable of being released. Both the end portions 9, 11 of the necklace 3 are connected to a later-described pair of pieces 13, 15 structuring the clasp 1.

Figure 2:
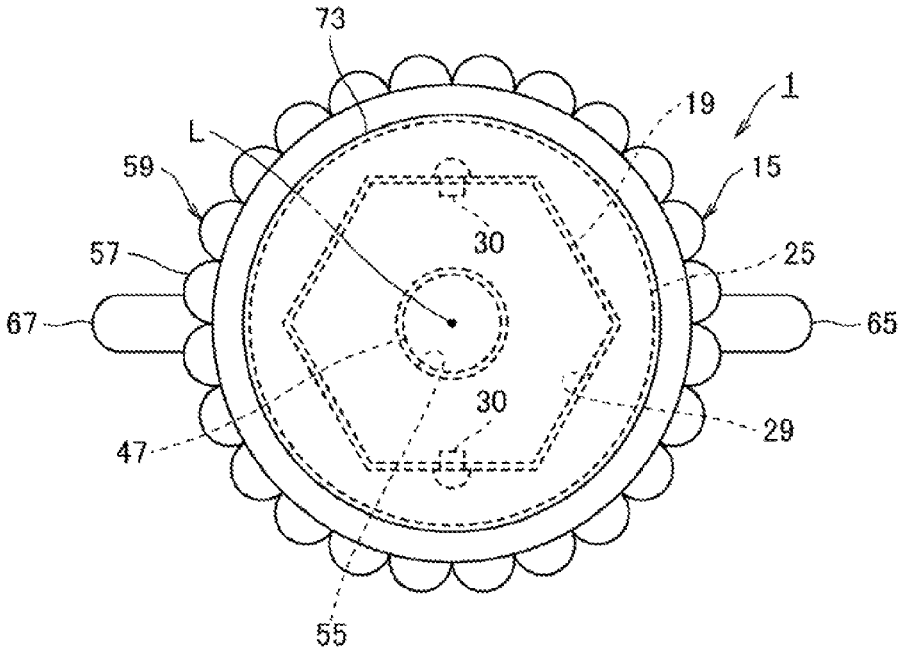
FIG. 2 is a plane view of one example of the clasp.
Figure 3:
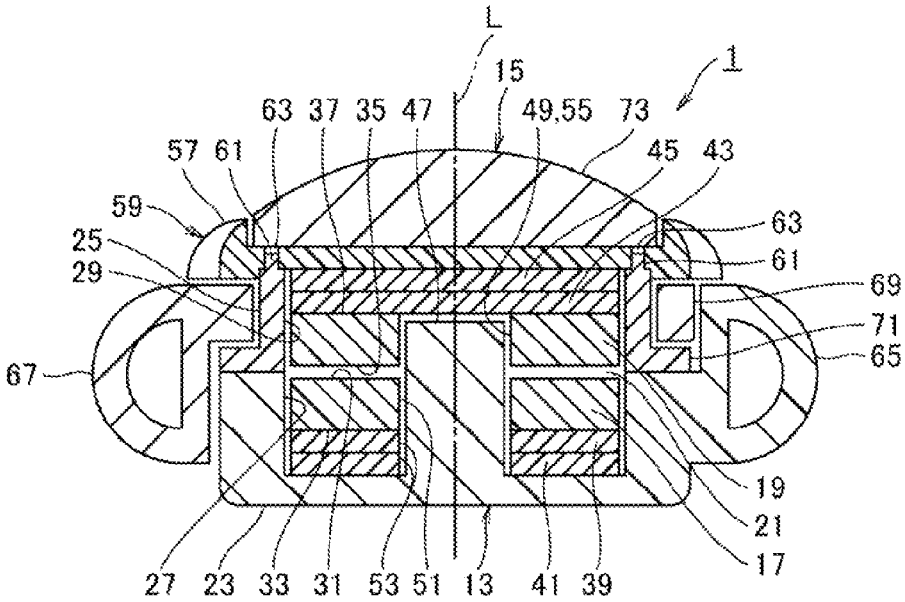
FIG. 3 is a vertical sectional view of the clasp illustrated in FIG. 2.
Figure 4:
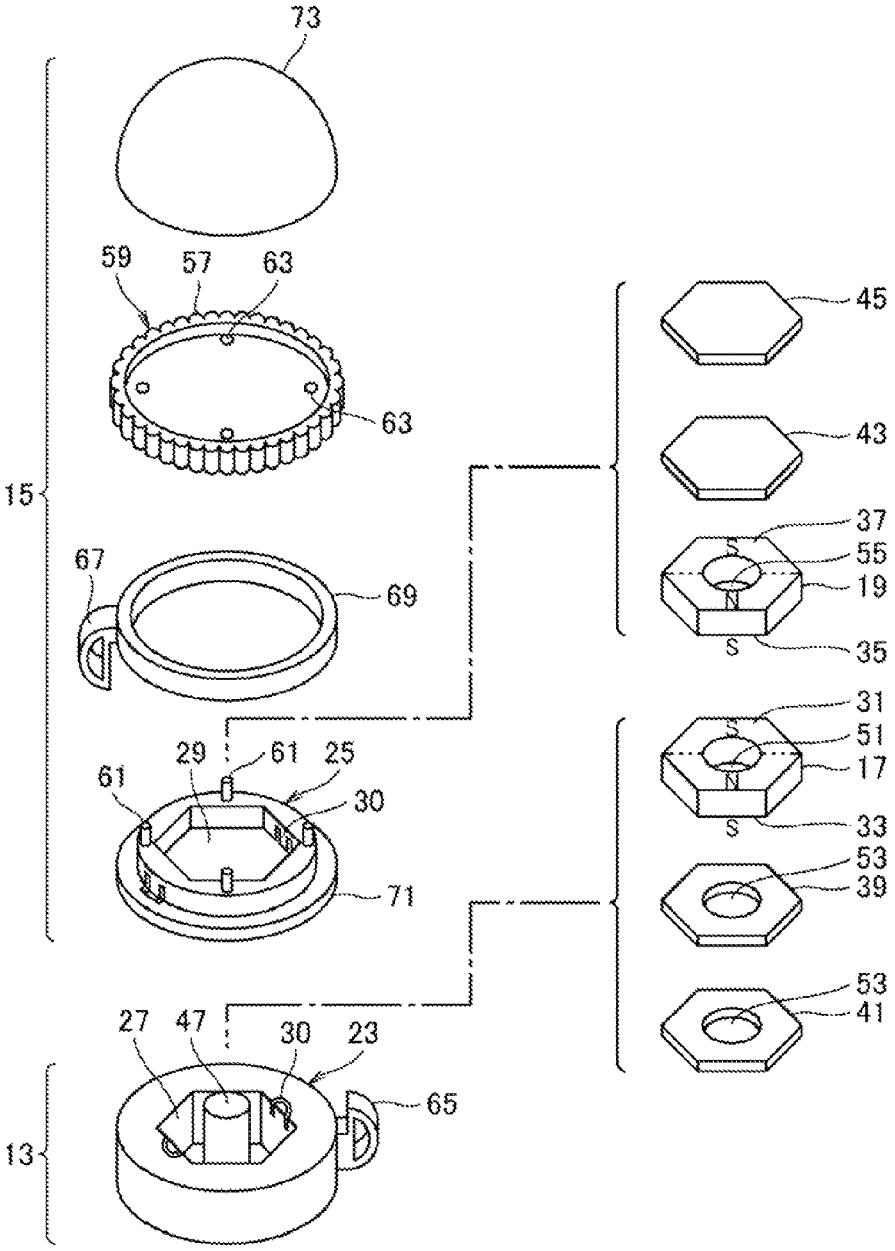
FIG. 4 is an exploded perspective view of the clasp illustrated in FIG. 2.

Next, referring to FIG. 2, FIG. 3, and FIG. 4, there is concretely illustrated one example of the clasp 1 according to the present invention. The clasp 1 includes the pair of pieces 13, 15 to be engaged with each other. A pair of permanent magnets 17, 19 is held in both the pieces 13, 15. That is, the permanent magnet 17 is held in the one piece 13, and the permanent magnet 19 is held in the other piece 15.

Both the pieces 13, 15, when seen in FIG. 3, are in a state of being engaged with each other to be touched. Both the pieces 13, 15, in the state of being engaged with each other, may relatively rotate about an axis line L common to both the pieces 13, 15, and further both the permanent magnets 17, 19 held in these pieces 13, 15 face each other with a small space 21 intervening therebetween.

The one piece (the lower piece seen in FIG. 3) 13 and the other piece (the upper piece seen in FIG. 3) 15 are provided with main bodies 23, 25. The illustrated main body 23 is formed in a flat bottomed cylindrical body as a whole, and further the main body 25 is formed in a flat cylindrical body as a whole. Both the permanent magnets 17, 19 each exhibit a plate shape or a block shape.

The main body 23 of the one piece 13 has a hole 27 having the one permanent magnet 17 held therein, and the permanent magnet 17 is fitted into the hole 27 to be fixed to the hole 27. Further, the main body 25 of the other piece 15 has a hole 29 having the other permanent magnet 19 held therein, and the permanent magnet 19 is fitted into the hole 29 to be fixed to the hole 29. In the illustrated example, a transverse cross-sectional shape of each of the holes 27, 29 and a planar shape of each of the permanent magnets 17, 19 are both set to be the same regular hexagon. The above setting enables the one piece 13 and the permanent magnet 17 held in the one piece 13 to integrally rotate about the axis line L without causing relative rotation between them, and further enables the other piece 15 and the permanent magnet 19 held in the other piece 15 to integrally rotate about the axis line L without causing relative rotation between them. It is possible to apply another polygon to the shape in place of the above-described regular hexagon, and further applying a circle is not restricted. Other geometric shapes are plausible.

Further, preferably, a plurality of claws 30 formed in a manner that one portions of walls defining the holes 27, 29 are cut out, in order to be capable of bending, are provided on the main bodies 23, 25 of both the pieces 13, 15. When seen in FIG. 4, the bent claws 30 on the main body 23 of the one piece 13 prevent the permanent magnet 17 from slipping out of the hole 27, and further, the bent claws 30 on the main body 25 of the other piece 15 work to hold the permanent magnet 19 and prevent the permanent magnet from slipping out of the hole 29.

Both the permanent magnets 17, 19 are each made of what, is called one in which multiple poles are magnetized in its both surfaces, and the one permanent magnet 17 has a front surface 31 and a rear surface 33 where each having multiple poles magnetized therein, and further the other permanent magnet 19 has a front surface 35 and a rear surface 37, where each having multiple poles magnetized therein. In the example illustrated in FIGS. 2 to 4, each of the permanent magnets 17, 19 is made of one in which four poles are magnetized in both the surfaces, and an N pole and an S pole being two magnetic poles appear on the front surface of each of the permanent magnets, and an S pole and an N pole being two magnetic poles appear on the rear surface of each of the permanent magnets (FIG. 4).

When both the pieces 13, 15 are engaged, both the permanent magnets 17, 19 have the front surfaces 31, 35 thereof face each other. At this time, when both the front surfaces 31, 35 face each other with the opposite magnetic poles, both the pieces 13, 15 are coupled to each other due to magnetic attraction between both the permanent magnets 17 and 19, and on the other hand, when both the front surfaces 31, 35 face each other with the same magnetic poles, the coupling of both the pieces 13, 15 is released due to magnetic repulsion between both the permanent magnets 17 and 19. The coupling of both the pieces 13, 15 and the release of the coupling may be generated by rotating one of both the pieces 13, 15 about the common axis line L relative to the other of both the pieces 13, 15.

When the permanent magnets 17, 19 of the above-described type in which the multiple poles are magnetized in both the surfaces are used, magnetic or magnetic flux leakage from both the pieces 13, in the state of being engaged is reduced as compared with the case when permanent magnets of a different type are used. This thus makes it possible to minimize an adverse effect of magnetism on a precision instrument such as a wristwatch worn by a wearer of the necklace 3, for example.

In order to further reduce the above-described magnetic leakage or magnetic flux leakage from both the pieces 13, 15, two pairs of back yokes 39, 41 and 43, 45 each formed by a plate-shaped body are preferably disposed in both the pieces 13, 15.

The two pairs of back yokes 39, 41 and 43, 45 each have a planar shape formed in the same regular hexagon as those of the respective permanent magnets 17, 19. Both the back yokes 39, 41 on one side are fitted into the hole 27 of the main body 23 of the one piece 13 in a state of being overlapped with each other, and the back yoke 39 comes into contact with the rear surface 33 of the permanent magnet 17. Further, both the back yokes 43, 45 on the other side are fitted into the hole 29 of the main body 25 of the other piece 15 in a state of being overlapped with each other, and the back yoke 43 comes into contact with the rear surface 37 of the permanent magnet 19. It is allowable to set the number of the above-described back yokes to be disposed in each of the holes 27, 29 to be one, or three or more in place of setting the back yokes 39 and 41, or 43 and 45 as one pair. Further, it is allowable to set each of the above-described back yokes to be a bottomed cylindrical body with a regular hexagonal transverse cross-sectional shape in place of forming each of the above-described back yokes by the plate-shaped body. The above-described bottomed cylindrical body is disposed such that a bottom wall thereof comes into contact with the rear surface of the above-described permanent magnet and a sidewall thereof does not come into contact with the above-described permanent magnet but surrounds the permanent magnet.

In the pair of pieces 13, 15, a shaft 47 and a hole 49 receiving the shaft therein for making the relative rotation about the axis line L common to the pieces 13, 15 more secure are provided. The shaft 47 extends from the one piece 13 along the axis line L in the hole 27 and a tip portion of the shaft 47 protrudes from the hole 27. Through holes 51, 53 through which the shaft 47 passes are provided in the permanent magnet 17 and both the back yokes 39, 41 that are disposed in the hole 27. Further, a through hole 55 receiving the tip portion of the shaft 47 protruding from the hole 27 of the one piece 13 therein is provided in the permanent magnet 19 disposed in the hole 29 of the other piece 15. The above through hole 55 is the hole 49 receiving the shaft 47 therein substantially. Accordingly, the shaft 47 is restrained in the through hole 55 to be capable of rotating, and this thus prevents displacement from being caused in a direction perpendicular to the common axis line L between both the pieces 13 and 15, and the smooth relative rotation about the axis line L common to both the pieces 13, 15 is secured. Further, the shaft 47 and the through hole 55 in which the shaft is received work to resist external forces perpendicular to the shaft 47 and maintain the coupled state of both the pieces 13, 15, which act on both the pieces 13, 15 coupled to each other.

The clasp 1 is further provided with a fingerhold portion 57 for rotating the other piece 15 relative to the one piece 13 in order to release the coupling of both the pieces 13, 15 brought into the coupled state due to the above-described magnetic attraction. In the example illustrated in FIGS. 2 to 4, the fingerhold portion 57 is provided on a tray 59 for a later-described ornament body 73 to be provided on the other piece 15, and is formed by an indented surface continuously extending around the periphery of the tray.

The tray 59, when seen in FIG. 3, is placed on and fixed to the main body 25 of the other piece 15, and closes the hole 29 of the main body 25. Further, a plurality of dowels 61 provided on the main body 25 and extending upward from the main body in parallel with the axis line L are received in dowel holes 63 provided in the tray 59. This prevents occurrence of relative rotation about the axis line L between the main body 25 and the tray 59. Accordingly, fingers are put on the fingerhold portion 57 on the periphery of the tray 59 to apply a rotational external force to the tray 59, thereby enabling the main body 25 to rotate about the axis line L relative to the main body 23.

Further, the clasp 1 is provided with loops 65, 67 for connecting both the pieces 13, 15 to both the end portions 9, 11 of the necklace 3, for example. The one loop 65 is fixed to the main body 23 of the one piece 13. Further, the other loop 67 is disposed so as to be capable of rotating around the periphery of the main body 25 of the other piece 15. The other loop 67 has a ring portion 69 continuing to the loop 67, and the ring portion 69 is placed on a flange portion 71 provided on the main body 25 to surround the periphery of the main body 25. The loop 67 capable of rotating may rotate according to a size of an angle formed when both the end portions 9, 11 of the necklace cross, which changes depending on a body shape of the wearer of, for example, the necklace 3 or on a length of the necklace 3.

Further, the clasp 1 is preferably provided with the ornament body 73. The ornament body 73 is made of a stone, a pearl, or the like, and is fitted into the tray 59 to be fixed to the tray 59.

An amount of magnetic leakage is measured at a plurality of positions on an outer surface of the clasp 1 in the state where both the pieces 13, 15 are coupled to each other (the state illustrated in FIG. 3), and then values of the measurement are 25 to 100 gausses. The above values are sufficiently small values as compared with measured values being 700 to 1000 gausses of magnetic leakage, which are obtained after the measurement is similarly performed in a different commercially available clasp.

Each of the permanent magnets 17, 19 in the clasp 1, being a measurement object of the above-described magnetic leakage, according to one example of the present invention, is made of the one having the four poles magnetized in both the surfaces, and has a magnetic force of 1680 gausses. The regular hexagon being the planar shape of each of the permanent magnets 17, 19 will have a size large enough to be inscribed in a circle with a diameter of 6 mm. Further, each of the back yokes 39, 43 and 43, 45 is made of stainless steel, and has a thickness dimension of 0.4 mm. Incidentally, the above-described different clasp that is commercially available has a magnetic force of 2600 gausses. The measurement may be performed in a manner using a gauss meter of TAPE-3251 manufactured by Yokogawa Electric Corporation, for example, and its probe is applied to the plurality of positions on the outer front surface of the clasp.

Figure 5:
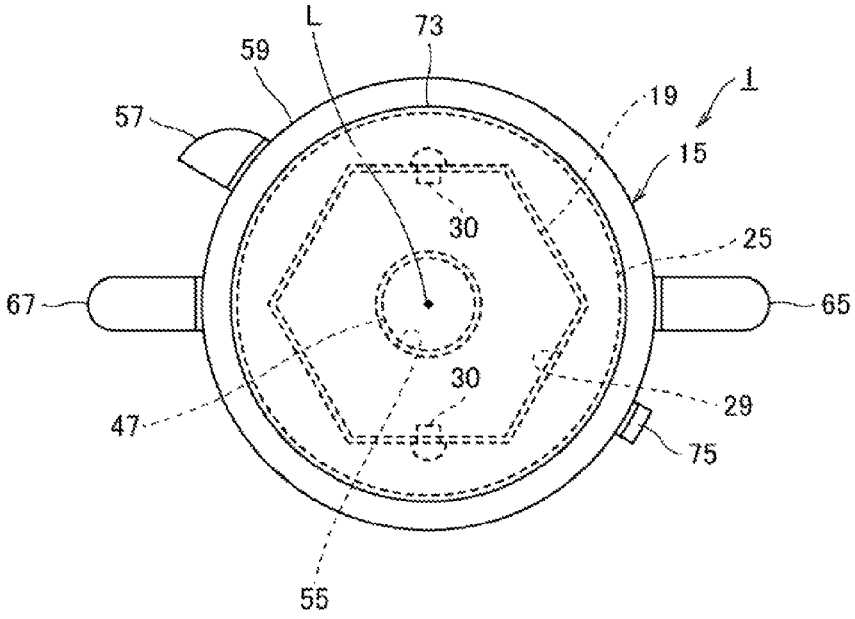
FIG. 5 is a plane view of another example of a clasp.
Figure 6:
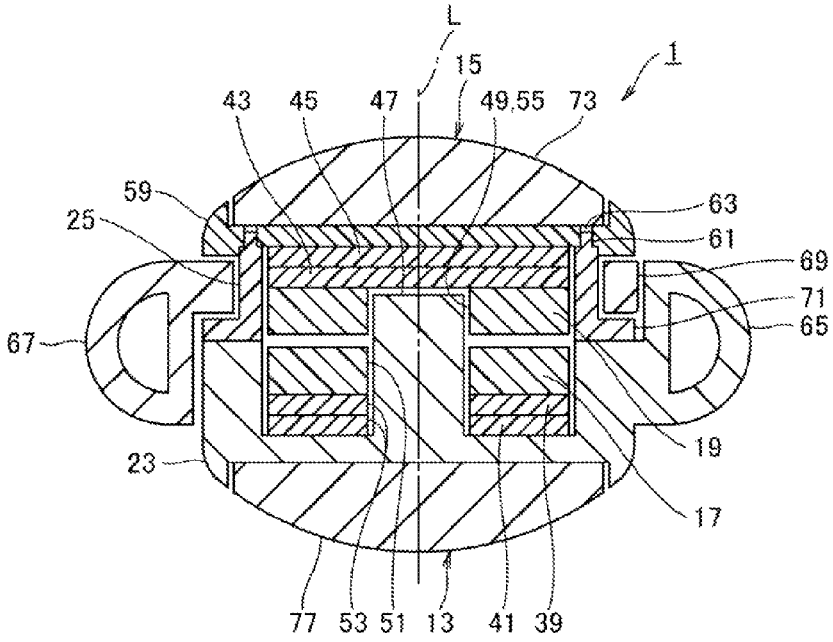
FIG. 6 is a vertical sectional view of the clasp illustrated in FIG. 5.
Figure 7:
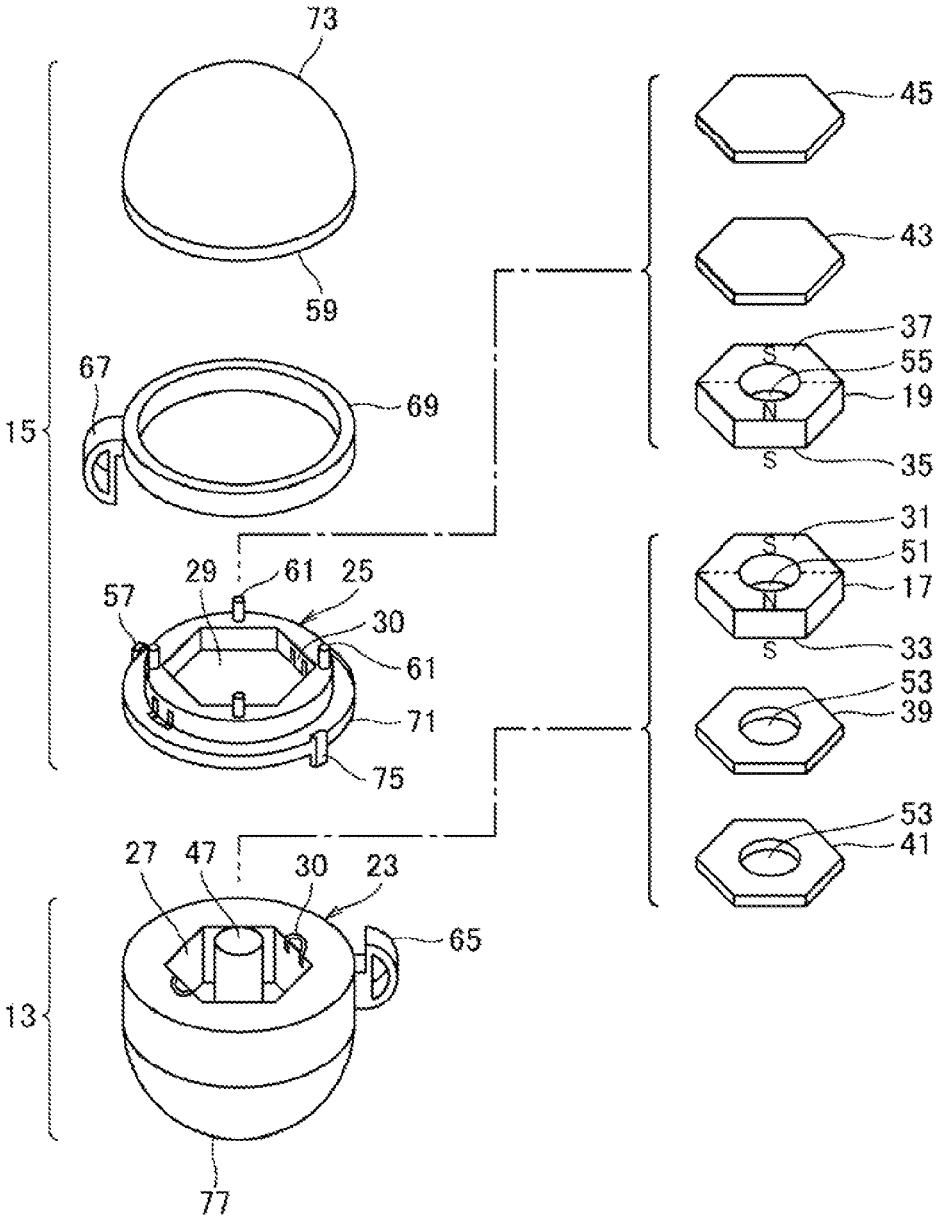
FIG. 7 is an exploded perspective view of the clasp illustrated in FIG. 5.

Next, as is in a clasp 1 according to another example illustrated in FIGS. 5 to 7, a fingerhold portion 57 for rotating the other piece 15 relative to one piece 13 in order to release coupling of both the pieces 13, 15 brought into a state of being coupled due to magnetic attraction may be provided on a flange portion 71 of a main body 25 of the other piece 15. The above fingerhold portion 57 is formed by a lever extending outward from the flange portion 71 in a diametrical direction of the main body 25. This makes it allowable to put a finger on the above-described lever to thereby rotate the other piece 15 about a common axis line L.

In the clasp 1 illustrated in FIGS. 5 to 7, a stopper 75 is further provided on the flange portion 71 of the main body 25 substantially 180 degrees apart from the above-described lever. The term "substantially" means as close to 180 degrees and which takes into account experimental deviations and is a term understood by a person of ordinary skill in the art. For example, 178 degrees would be an example of "substantially 180 degrees." The stopper 75 works to limit a rotational movement of a loop 67. This thus enables the loop 67 to abut on the stopper 75. Further, in the example illustrated in FIGS. 5 to 7, a different ornament body 77 is attached to a main body 23 of the one piece 13. The clasp 1 illustrated in FIGS. 5 to 7, in terms of its structure, does not differ from the clasp 1 illustrated in FIGS. 2 to 4 except what is described above.

Figure 8:
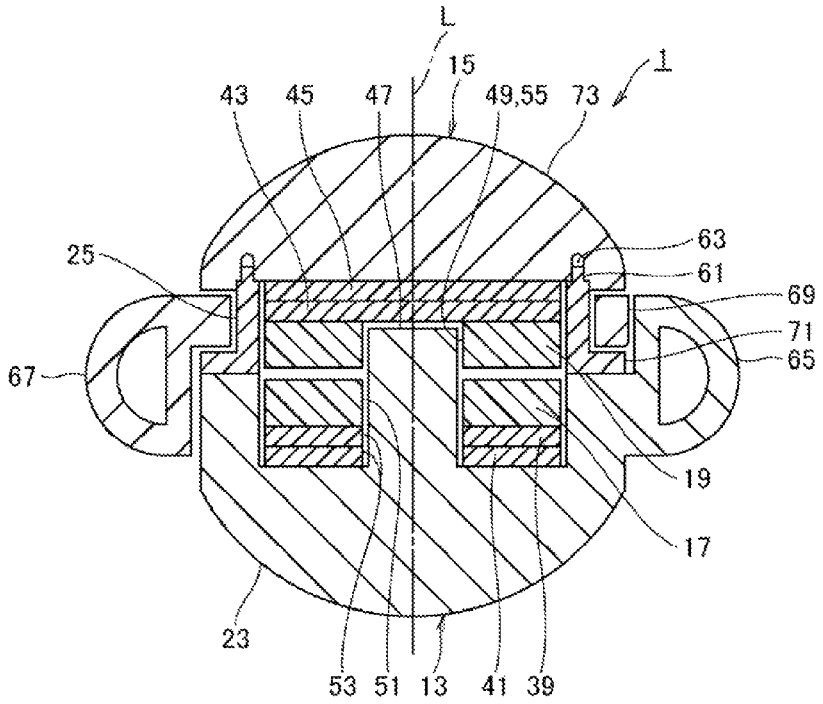
FIG. 8 is a vertical sectional view of another example of a clasp.
Figure 9:
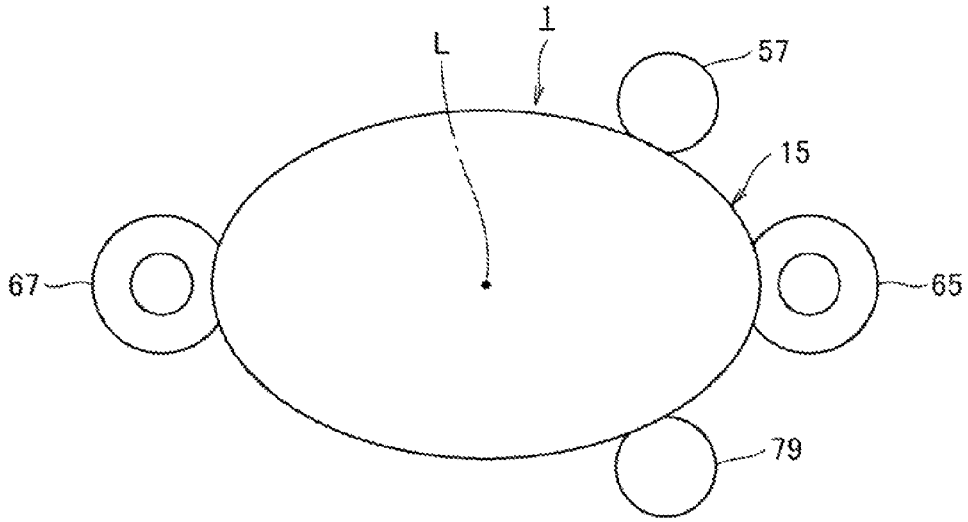
FIG. 9 is a plane view of another example of a clasp.
Figure 10:
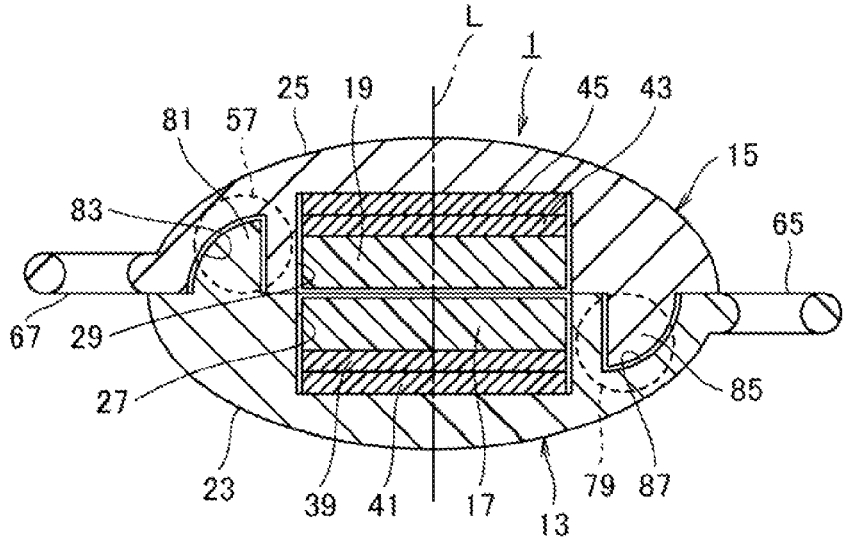
FIG. 10 is a vertical sectional view of the clasp illustrated in FIG. 9.
Figure 11:
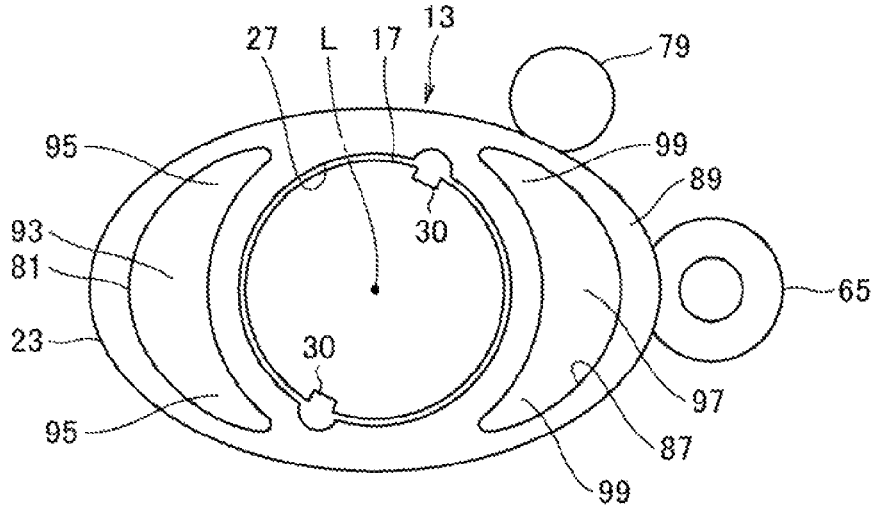
FIG. 11 is a plane view of one piece structuring the clasp illustrated in FIG. 9.
Figure 12:
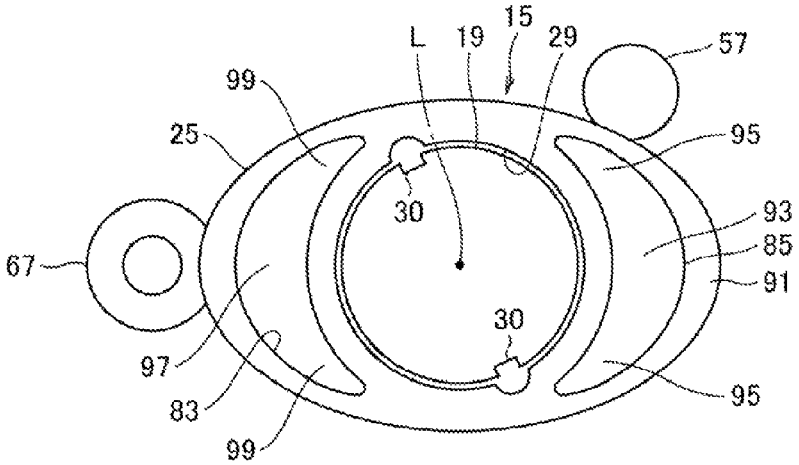
FIG. 12 is a bottom view of the other piece structuring the clasp illustrated in FIG. 9.
Figure 13:
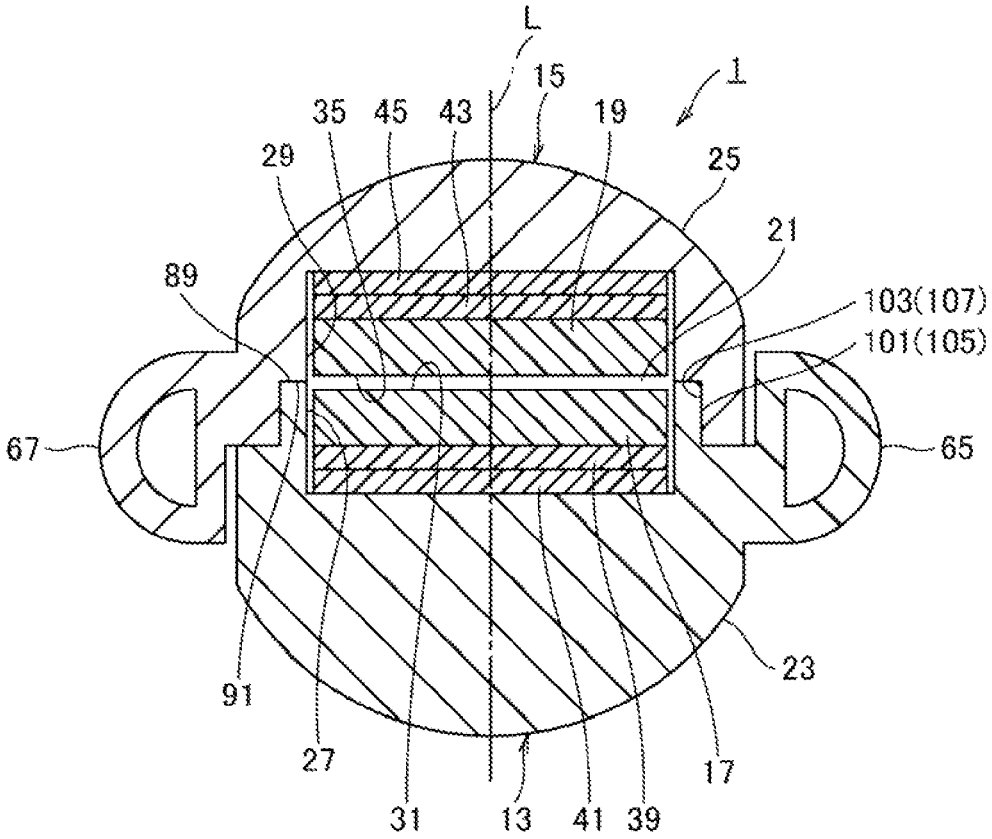
FIG. 13 is a vertical sectional view of another example of a clasp.
Figure 14:
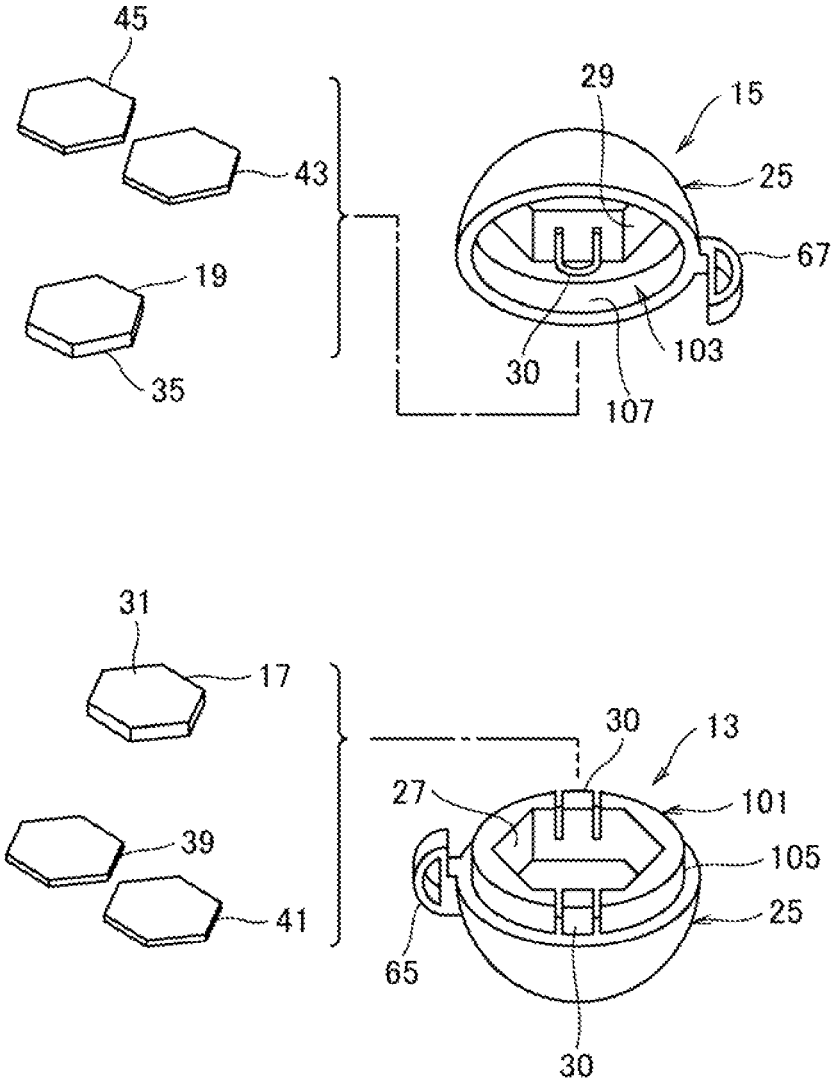
FIG. 14 is an exploded perspective view of the clasp illustrated in FIG. 13.
Figure 15:
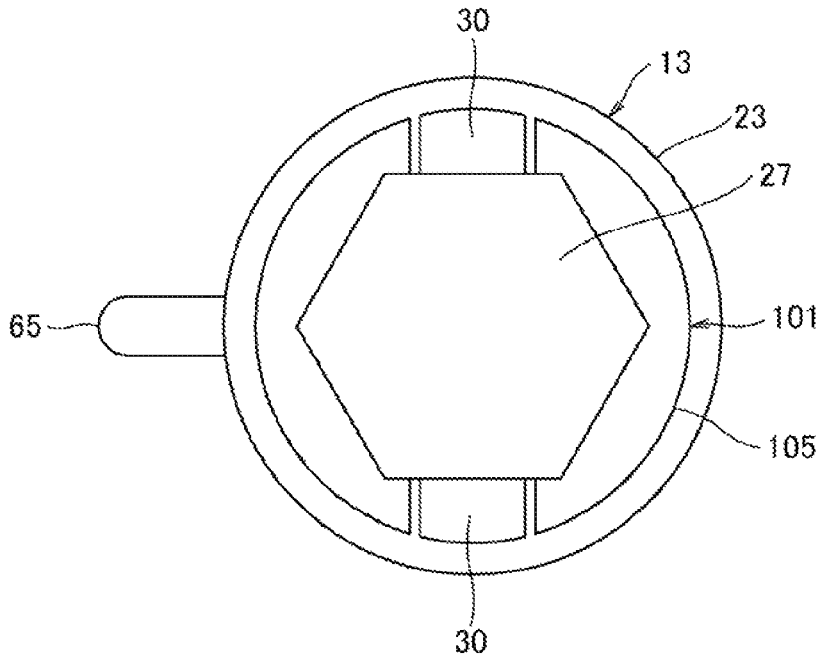
FIG. 15 is a plane view of one piece of the clasp illustrated in FIG. 13.
Figure 16:
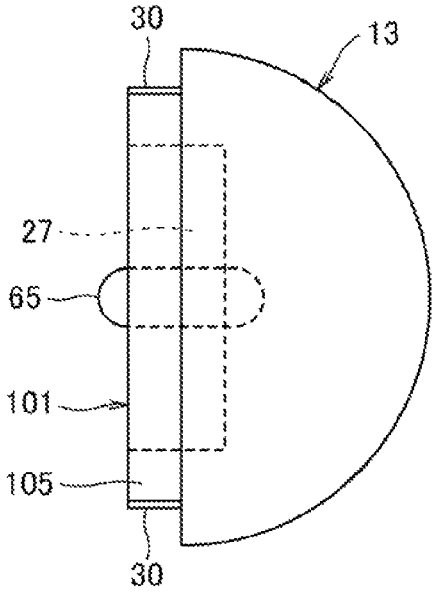
FIG. 16 is a side view of the one piece of the clasp illustrated in FIG. 13.
Figure 17:
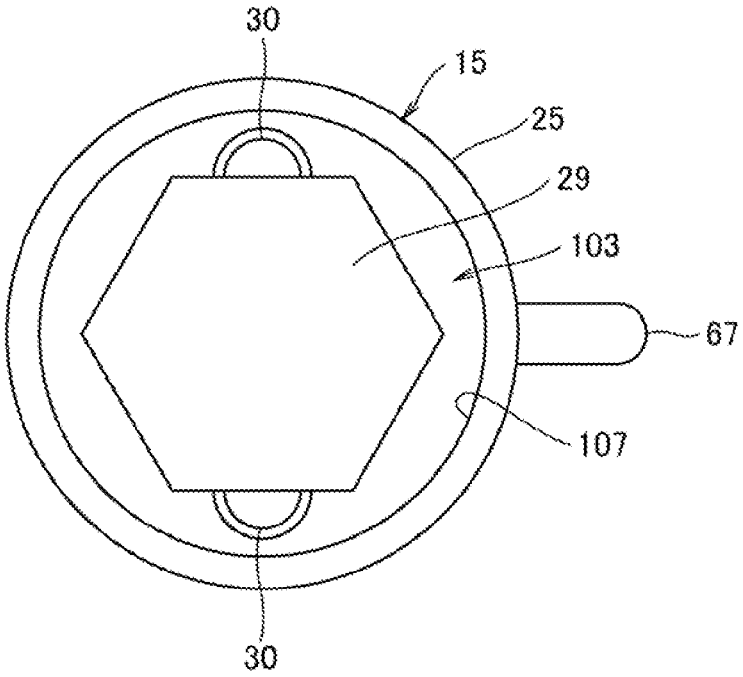
FIG. 17 is a bottom view of the other piece of the clasp illustrated in FIG. 13.
Figure 18:
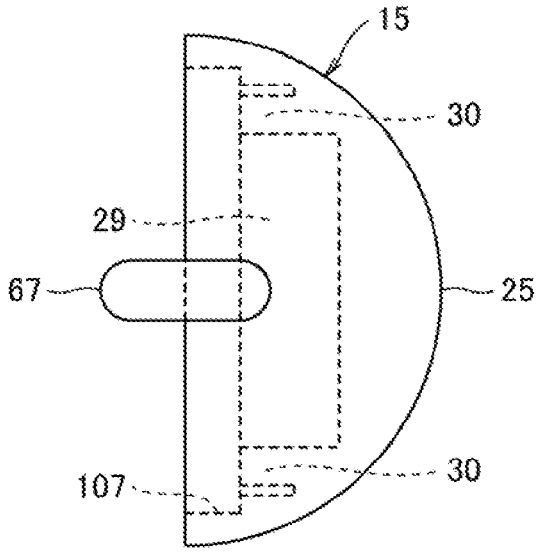
FIG. 18 is a side view of the other piece of the clasp illustrated in FIG. 13.

Further, as is in another example of a clasp 1 illustrated in FIG. 8, it is possible to omit the tray 59 in the clasp 1 illustrated in each of FIGS. 2 to 4 and FIGS. 5 to 7 from the clasp 1 illustrated in FIG. 8. In the clasp 1 illustrated in FIG. 8, an ornament body 73 is directly attached to a main body 25 of the other piece 15. In the ornament body 73, a plurality of dowel holes 63 receiving a plurality of dowels 61 that extend from the main body 25 therein are provided. Further, in the clasp 1 illustrated in FIG. 8, a main body 23 of one piece 13 also has a function as an ornament body. In the illustrated example, a contour of the main body 23 is formed as one portion of a spherical surface. The main bodies 23, 25 and the ornament body 73 may each be formed of, for example, a metallic material. The clasp 1 illustrated in FIG. 8, in terms of its structure, does not differ from the clasp 1 illustrated in FIGS. 2 to 4 except what is described above.

In FIGS. 9 to 12, a clasp 1 of another example is further illustrated. The above clasp 1, in terms of its structure, differs from the clasp 1 illustrated in FIGS. 2 to 4 in two points to be described in the following.

First, the tray 59 having the fingerhold portion 57 that is illustrated in FIGS. 2 to 4 provided thereon is not included. In place of the above tray 59, in the example in FIGS. 9 to 12, a contour of a main body 25 of the other piece 15 is adjusted so that the main body 25 also has a function as an ornament body, and further a pair of fingerhold portions 57, 79 is provided on the main body 25 of the other piece 15 and a main body 23 of one piece 13. These fingerhold portions 57, 79 are each formed by a spherical-shaped lever, and the fingerhold portion 57 continues to a peripheral edge portion of the main body 25 and the fingerhold portion 79 continues to a peripheral edge portion of the main body 23. Both the fingerhold portions 57, 79 are disposed at positions facing each other when seen in FIG. 9. Further, a loop 67 of the other piece 15 is attached to the main body 25 of the other piece 15 so as to be integral with the main body 25. The two fingerhold portions 57, 79 are pinched by fingers to have external forces applied thereto in the direction in which they approach each other, thereby enabling one of both the pieces 13, 15 to rotate about a common axis line L relative to the other of both the pieces 13, 15. Incidentally, the disposition of one of the two fingerhold portions 57, 79, for example, the fingerhold portion 57 on the other piece 15 side may also be omitted. This makes it possible to apply a force to the fingerhold portion 79 on the one piece 13 side while pressing the other piece 15 to thereby rotate the one piece 13 about the common axis line L.

Second, the shaft 47 and the hole 49 receiving the shaft 47 therein that are illustrated in FIGS. 2 to 4 are not included. Thus, in the example illustrated in FIGS. 9 to 12, a permanent magnet 17 disposed in a hole 27 in the main body 23 of the one piece 13 does not have a through hole, and further two back yokes 39, 41 also do not have a through hole. Further, a permanent magnet 19 disposed in a hole 29 in the main body 25 of the other piece 15 also does not have a through hole.

In place of the shaft 47 and the hole 49 receiving the shaft 47 therein that are illustrated in FIGS. 2 to 4, in the example illustrated in FIGS. 9 to 12, a projection 81 is provided on the main body 23 of the one piece 13 and a groove 83 receiving the projection therein is provided in the main body 25 of the other piece 15. Further, a projection 85 is provided on the main body 25 of the other piece 15 and a groove 87 is provided in the main body 23 of the one piece 13. The projection 81 and the projection 85 have the same shape, and further the groove 83 and the groove 87 have the same shape.

One pair of the projection 81 and the groove 83 and the other pair of the projection 85 and the groove 87 are provided on and in abutting surfaces 89, 91 of both the main bodies 23, 25 facing and abutting each other when both the pieces 13, 15 are engaged. The projection 81 and the groove 87 are disposed around the hole 27 of the main body 23 of the one piece 13 to face each other, and each extend around the axis line L in a circumferential direction of the axis line L. Further, the projection 85 and the groove 83 are disposed around the hole 29 of the main body 25 of the other piece 15 to face each other, and each extend around the axis line L in a circumferential direction of the axis line L. Further, each of the projections 81, 85 has a center portion 93 and both end portions 95 in terms of the above-described circumferential direction of the axis line L, and has a thickness dimension gradually decreasing from the center portion 93 to the respective end portions 95. Further, each of the grooves 83, 87 has a center portion 97 and both end portions 99 in terms of the above-described circumferential direction of the axis line L, and has a depth dimension gradually decreasing from the center portion 97 to the respective end portions 99.

Accordingly, when a rotational external force is applied to one of both the pieces 13, 15 in the state of being engaged with each other to be coupled, the above-described projections received in the above-described grooves each move from one of both the end portions of the groove to the other of both the end portions in the above-described groove by receiving a guiding function of the above-described groove. As a result, one of both the pieces 13, 15 rotates about the common axis line L relative to the other of both the pieces 13, 15. At this time, the above-described projections move onto the end portions in the above-described shallow grooves, and an interval between both the pieces 13 and 15 gradually increases. Further, the above-described grooves and the above-described projections received in the above-described grooves work to resist external forces perpendicular to the axis line L and maintain the coupled state of both the pieces 13, 15, which act on both the pieces 13, 15 coupled to each other.

Finally, a clasp 1 of another example will be further illustrated in FIGS. 13 to 18. The above clasp 1, in terms of its structure, differs from the clasp 1 illustrated in FIGS. 2 to 4 in two points to be described in the following.

First, the fingerhold portion 57 and the tray 59 on which the fingerhold portion is provided that are illustrated in FIGS. 2 to 4 are not included. In place of providing the fingerhold portion 57, in the example illustrated in FIGS. 13 to 18, loops 65, 67 of both pieces 13, 15 are both fixed to main bodies 23, 25 of both the pieces, and one of both the pieces 13, 15 may be rotated about a common axis line L relative to the other of both the pieces 13, 15 via both the loops 65, 67. Further, in place of providing the tray 59, in the example illustrated in FIGS. 13 to 18, a contour of the main body 25 of the other piece 15 is adjusted so that the main body 25 also has a function as an ornament body. Incidentally, a contour of the main body 23 of the one piece 13 is also adjusted so that the main body 23 also has a function as an ornament body.

Second, the shaft 47 and the hole 49 receiving the shaft 47 therein that are illustrated in FIGS. 2 to 4 are not included. Thus, in the example illustrated in FIGS. 13 to 18, a permanent magnet 17 disposed in a hole 27 in the main body 23 of the one piece 13 does not have a through hole, and further two back yokes 39, 41 also do not have a through hole. Further, a permanent magnet 19 disposed in a hole 29 in the main body 25 of the other piece 15 also does not have a through hole.

In the example illustrated in FIGS. 13 to 18, in place of the shaft 47 and the hole 49 receiving the shaft 47 therein that are illustrated in FIGS. 2 to 4, the main body 23 of the one piece 13 and the main body 25 of the other piece 15, when seen in a state of being coupled, are provided with a projecting portion 101 and a recessed portion 103 receiving the projecting portion therein that face each other. The projecting portion 101 and the recessed portion 103 have circumferential surfaces 105, 107 each formed by a cylindrical surface, which come into contact with each other to be capable of sliding about the axis line L common to both the pieces 13, 15, and further have end surfaces defining abutting surfaces 89, 91 of both the main bodies 23, 25.

Consequently, when a rotational external force is applied to one of both the pieces 13, 15 in the state of being engaged with each other to be coupled, the recessed portion 103 and the projecting portion 101 received in the recessed portion 103 slide on the circumferential surfaces 105, 107 of the projecting portion 101 and the recessed portion 103. As a result, one of both the pieces 13, 15 rotates about the common axis line L relative to the other of both the pieces 13, 15. Further, the recessed portion 103 and the projecting portion 101 received in the recessed portion 103 work to resist external forces perpendicular to the axis line L and maintain the coupled state of both the pieces 13, 15, which act on both the pieces 13, 15 coupled to each other.

The term "substantially" referred in the specification takes into account experimental deviations and is a term readily understood by a person of ordinary skill in the art.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A clasp comprising:

a) a pair of pieces capable of being engaged with each other, and, when engaged, capable of both rotating about an axis line common to said both pieces, the pair comprising a first piece and a second piece;

b) a respective permanent magnet for each of the pieces and each magnet being held in said respective piece;

c) each magnet having front and rear surfaces, wherein each of the surfaces has alternating North and South magnetized poles, and when said both pieces are engaged, the respective front surfaces of the first and second pieces face each other and a North magnetized pole on the front surface of the first piece faces a South magnetized pole on the front surface of the second piece;

d) means for causing the pair of pieces to release from each other merely by rotating one of the pieces relative to the other of the pieces about the axis line in either circumferential direction about the axis line until the respective front surfaces of the first and second pieces face each other with same magnetized poles and the pair of pieces release from each other due to magnetic repulsion between the magnets;

e) the pieces including a projecting portion and a recessed portion receiving the projecting portion therein, the portions facing each other; and f) the projecting portion and the recessed portion having respective circumferential surfaces, each of the circumferential surfaces being formed by a cylindrical surface and coming into contact with each other in order to be capable of sliding about the axis line common to the both pieces.

2. The clasp according to claim 1, further comprising: a back yoke held in each of said pieces and coming into contact with the rear surface of each of said pair of permanent magnets.

3. The clasp according to claim 2, further comprising:

a shaft extending along the axis line common to said both pieces and a hole receiving the shaft therein, wherein said permanent magnet of one pair and said back yoke that are held in said one piece have a through hole for the shaft, and the other permanent magnet held in said other piece has a through hole defining the hole receiving the shaft therein.

4. The clasp according to claim 1, wherein said both pieces include a projection formed around the axis line common to said both pieces and extending in a circumferential direction of the axis line; and a groove receiving the projection therein and exerting a guiding function in the circumferential direction of the common axis line on the projection, wherein the projection includes a projection center portion and two projection end portions in terms of the circumferential direction of the common axis line, and has a thickness dimension gradually decreasing from the projection center portion to the projection end portions, and the groove has a groove center portion and two groove end portions in terms of the circumferential direction of the common axis line, and has a depth dimension gradually decreasing from the groove center portion to the groove end portions.

5. The clasp according to claim 1, wherein said other piece includes a fingerhold portion for generating rotation of said other piece relative to said one piece.

6. The clasp according to claim 1, wherein said one piece includes a loop attached thereto so as to be capable of rotating around the periphery of said one piece; and said other piece includes a loop fixed thereto.

7. The clasp according to claim 1, wherein each of said pieces includes a hexagonal hole for holding each of said permanent magnets therein, and each of said permanent magnets includes a planar shape substantially the same as that of the respective hole.

8. The clasp according to claim 1, wherein:

a) the pieces are coupled to each other due to magnetic attraction between the magnets, when the respective front surface of the first piece and the respective front surface of the second piece face each other with opposite magnetized poles; and b) the pieces are released from each other due to magnetic repulsion between the magnets, when the respective front surface of the first piece and the respective front surface of the second piece face each other with the same magnetized poles.

9. The clasp according to claim 1, wherein each piece is configured to have a main body being formed as a flat cylindrical body a including a hole for receiving a respective magnet, in order to be allow the each piece and the respective magnet to rotate about the axis line without causing relative rotation between the each piece and the respective magnet.

* * * * *